US007585393B2

(12) United States Patent
Sekiya et al.

(10) Patent No.: US 7,585,393 B2
(45) Date of Patent: Sep. 8, 2009

(54) ANTI-STAINING AGENT FOR PAPER MACHINE, AND METHOD FOR PREVENTING STAINS USING THE SAME

(75) Inventors: Kunio Sekiya, Tokyo (JP); Hiroshi Sekiya, Tokyo (JP)

(73) Assignee: Maintech Co., Ltd., Tokyo (JP)

( * ) Notice: Subject to any disclaimer, the term of this patent is extended or adjusted under 35 U.S.C. 154(b) by 401 days.

(21) Appl. No.: 10/501,303

(22) PCT Filed: Jul. 29, 2002

(86) PCT No.: PCT/JP02/07671

§ 371 (c)(1),
(2), (4) Date: Jul. 1, 2005

(87) PCT Pub. No.: WO03/060230

PCT Pub. Date: Jul. 24, 2003

(65) Prior Publication Data

US 2006/0162888 A1 Jul. 27, 2006

(30) Foreign Application Priority Data

Jan. 11, 2002 (JP) ..... 2002-005297

(51) Int. Cl.
*D21F 1/32* (2006.01)

(52) U.S. Cl. ..... 162/199; 162/263; 162/158

(58) Field of Classification Search ..... 162/199, 162/263, DIG. 4, 164.4, 158
See application file for complete search history.

(56) References Cited

U.S. PATENT DOCUMENTS

| | | | | |
|---|---|---|---|---|
| 5,885,419 | A * | 3/1999 | Nguyen et al. | 162/174 |
| 6,139,911 | A | 10/2000 | Vanhecke et al. | |
| 6,267,842 | B1 * | 7/2001 | Ona et al. | 162/135 |
| 6,306,814 | B1 * | 10/2001 | Appel et al. | 510/446 |
| 2001/0037529 | A1 * | 11/2001 | Igarashi et al. | 8/115.51 |

FOREIGN PATENT DOCUMENTS

| | | | |
|---|---|---|---|
| DE | 195 39 523 | A1 | 4/1997 |
| EP | 1 124 006 | A1 | 8/2001 |
| GB | 2 284 833 | A | 6/1995 |
| JP | 52-25106 | | 2/1977 |
| JP | 04-130190 | | 5/1992 |
| JP | 7-292382 | * | 7/1995 |
| JP | 07-292382 | | 11/1995 |
| JP | 11-513758 | | 11/1999 |

* cited by examiner

*Primary Examiner*—Mark Halpern
(74) *Attorney, Agent, or Firm*—Flynn, Thiel, Boutell & Tanis, P.C.

(57) ABSTRACT

Provided is a paper machine contamination preventive agent that has high fixability to rolls and the like of a paper machine, that positively finds a silicone oil capable of imparting releaseability and water-repellent properties to the rolls or the like immediately upon being supplied to the rolls or the like, and that uses the silicone oil as a main component. Further provided is a paper machine contamination preventive agent using a silicone oil that permits transfer of less foreign matters from a wet paper web than that in a case where a contamination preventive agent containing a dimethylpolysiloxane base oil is a main component. The paper machine contamination preventive agent is fed to a paper machine and has a sidechain-type modified silicone oil or a sidechain both-termini modification silicone oil as a main component.

11 Claims, 8 Drawing Sheets

ANTI-STAINING AGENT FOR PAPER MACHINE, AND METHOD FOR PREVENTING STAINS USING THE SAME

This application is a 371 of PCT/JP02/07671 filed on 29 Jul. 2002.

TECHNICAL FIELD

Technical Field of the Invention

The present invention relates to a paper machine contamination preventive agent and contamination preventive method using the agent. More specifically, the present invention relates to a paper machine contamination preventive agent using a sidechain-type silicone oil or a sidechain both-termini type modified silicone oil as main components and to a contamination preventive method using the agent.

BACKGROUND ART

Related Art

In a paper machine, a paper product is manufactured in such a manner that first a sheet-shaped wet web is formed from a source material, dewatered, and then dried.

FIG. 1 schematically shows, by way of an example paper machine, the overall structure of a Yankee dryer mounted paper machine.

Generally, at a press part B, dewatering is performed in a manner that a wet paper web W (shown by a dotted line in the drawing) is nipped between pairs of press rolls B2, B4, and B6 by being overlaid on felts B1, B3, and B5, and water in the wet paper web is transferred to the felts at nip pressures between the rollers.

At a drier part C, the wet paper web W dewatered at the press part B is sandwiched between individual dryer rolls C1 to C6 and a canvas C7 or C8, and then successively is dried using dryer roll heat under a pressure applied with the canvas.

In this manner, the wet paper web travels through the inside of the paper machine while intensively pressed by the component members, such as the press roll, dryer roll, and canvas (which hereafter will be referred to as "roll(s) and/or the like" depending on the case).

Wet paper webs of the aforementioned type contain various foreign matters (contaminants), such as gum pitches and tar contained in pulp feedstocks per se; hot-melt ink, fine fibers, and paint contained in waste paper feedstocks; and various additives for assisting the paper strength and whiteness degree.

A majority of foreign matters of the types mentioned above have a sticky adhesion. As such, if paper manufacture is performed without imparting any measure to rolls and the like, foreign matters transfer to surfaces of the rolls and the like to contaminate the surfaces when the wet paper web is pressed to the roll or the like.

The contamination thus caused causes problems such as an over-adherence and/or burning of a wet paper web with respect to rolls and paper breakage, frequently requiring cleaning of rolls and the like and causing significant deterioration of paper-product production efficiency.

In addition, because of such adhesion of foreign matters, undesired formations such as irregular blisters and scuffing are caused on the surface of the paper per se. Thereby, for example, the paper strength is reduced and/or the canvas are blinded, thereby causing a drying failure of the wet paper webs, consequently providing adverse effects directly or indirectly to the product quality per se.

Under these circumstances, development has been progressed for contamination preventive agents and contamination preventive methods that prevent such contamination of rolls and the like due to foreign matters as described above.

Amount various methods having been proposed, a method being popularly employed at the present is a method that applies a contamination preventive agent containing a wax or silicone oil to the surfaces of rolls and canvases.

In particular, the method using the silicone oil is based on the concept that a film having a silicone-oil intrinsic releaseability and water-repellent properties on the surfaces of the rolls and like, and foreign matters are prevented from transferring from the wet paper web by using the release and water relent functionality of the film.

The silicone oil is a chained organosiloxane based oil in which siloxane-coupling repetition in the form of (—Si—O—)n is used as a main chain and that has an organic group such as an alkyl group or aryl group and other organic functional groups as sidechains.

The sidechains, terminal groups, and the like are substituted for various other organic functional groups, forming various types of oils.

Among them, a dimethylpolysiloxane base oil (generic name: "dimethyl") is employed as a silicone oil for the above-described purpose in a significant large number of cases.

A primary reason therefor is that among various silicone oils, the dimethylpolysiloxane base oil (refer to Table 1) is of a most popular and fundamental type formed of a methyl group, which is an alkyl group that has the simplest sidechain structure, and is hence most inexpensive and easily available (for example, for the economical reason, the dimethylpolysiloxane base oil is employed in the techniques disclosed in Japanese Unexamined Patent Application Publication No. 7-292382).

TABLE 1

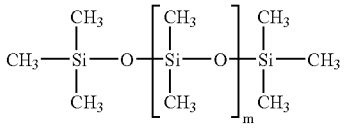

Dimethylpolysiloxane base oils, as described above, are known to exhibit their intrinsic releaseability and water repellent properties for the following reasons. As schematically shown in FIG. 2, when a treatment such as coating or baking of the oil on a solid surface S is conducted, the chained molecules of the dimethylpolysiloxane base oil form a film in a state where the O atoms of a main chain are arranged opposite to the solid surface S, and a methyl group having a hydrophobicity and low reactivity is outwardly arranged.

In this state, the dimethylpolysiloxane base oil is intensively fixed onto the solid surface S, not permitting an easy release, and thus forms a film that steadily exhibits the intrinsic releaseability and water repellent functionality.

The silicone oil is coated on the surfaces of the rolls and the like of the paper machine to expect the effects that with the oil being coated, films as described above are formed on the surfaces of the rolls and the like, thereby enabling foreign matters to be prevented from transferring to the rolls and the like from the wet paper web. In practice, however, even when the dimethylpolysiloxane base oil has been applied to the rolls and like of the paper machine, sufficient contamination prevention effects expected from the above-described silicone-oil intrinsic releaseability and water repellent properties cannot be constantly exhibited. For example, even when the contamination preventive agent containing the dimethylpolysiloxane base oil has been applied to the rolls and the like in the state where the wet paper web is being supplied, the dimethylpolysiloxane base oil transfers to the wet paper web before entering the above-described state. This results in permitting a considerable amount of foreign-matter originated dirty residues, which has been transferred from the wet paper web, to adhere to the surfaces of the rolls and the like.

When this state remains, the above-described problems due to the contamination of the rolls and the like are caused.

More specifically, even with the dimethylpolysiloxane base oil being used on the press roll and like of the paper machine, the intrinsic releaseability and water repellent properties of silicone oil are not effectively exhibited, and adversely, transfer of foreign matters from the wet paper web to the rolls and the like is permitted.

If the feed amount of the oil is increased, the amount of the entrained oil paper products is then increased. This causes various other drawbacks of, for example, deteriorating the ink-fixing properties of the paper products and blinding the canvases, thereby causing a drying failure of the web paper web.

In addition, if the feeding of the dimethylpolysiloxane base oil is stopped while the wet paper web is being supplied to the press rolls, the surfaces of the rolls and the like immediately lose the releaseability and water-repellent properties.

These phenomena at least represent that even with the coated dimethylpolysiloxane base oil, a film having the releaseability and water repellent properties is not effectively formed on the surfaces of the rolls and the like.

Adversely, the phenomena represent that fixability (property not allowing easy release of the oil after adhesion) of the dimethylpolysiloxane base oil to the surfaces of the rolls and the like is not necessarily high and the oil per se easily transfers from the rolls and the like to the wet paper web before forming a film.

Silicone oils have long been used for contamination prevention of paper machines.

In addition, as described above, silicone oils include not only dimethylpolysiloxane base oils of the above-described type, but also include various modified silicone oils having the structure in which the sidechains and terminal groups are substituted for various other organic functional groups.

Nevertheless, while the problems as described above are held pending resolution, the dimethylpolysiloxane base oils have been and are kept employed as a contamination preventive agent of the paper machine only for the reason that the oils are inexpensive.

No techniques are as yet provided to date that have been developed in consideration of even operating mechanisms of the silicone oils and that positively find, from various silicone oils, optimal oils of the type capable of overcoming the above-described problems and that effectively uses the optimal oils.

Problems to be Solved by the Invention

In the background with the circumstances, the present invention is made to solve or overcome the problems described above.

Specifically, an object of the present invention is to positively find a silicone oil that has a high fixability to rolls and the like of a paper machine and that is capable of exhibiting releaseability and water-repellent properties immediately upon being supplied thereto and to provide a paper machine contamination prevention agent using the oil as a main component.

Another object of the present invention is to provide a paper machine contamination preventive agent using a silicone oil that permits transfer of less foreign matters from a wet paper web than that in a case where a contamination preventive agent containing a dimethylpolysiloxane base oil as a main component.

Another object is to provide a contamination preventive method for a press roll, dryer roll, and canvas using the paper machine contamination preventive agent.

DISCLOSURE OF THE INVENTION

Means for Solving the Problems

As described above, the inventor conducted extensive research and studies to overcome the problems in the background, and consequently discovered and acquired the knowledge that a sidechain-type modified silicone oil using sidechain both-termini type modified silicone oil having organic functional groups for sidechains can be quickly fixed to a press roll or the like and that using the oil having a low viscosity does not cause problems such as clogging of injection outlets of a spray nozzle. Then, with this knowledge, the inventor has come to complete the present invention.

More specifically, the present invention is:

(1) A paper machine contamination preventive agent to be supplied to a paper machine, wherein the paper cutter lies in a paper machine contamination preventive agent comprising a sidechain-type modified silicone oil or a sidechain both-termini modified silicone oil as a main component.

(2) A paper machine contamination preventive agent to be supplied to a paper machine, wherein the paper machine contamination preventive agent lies in a paper machine contamination preventive agent comprising a sidechain-type modified silicone oil as a main component.

(3) The sidechain-type modified silicone oil lies in a paper machine contamination preventive agent that is reactive.

(4) The sidechain-type modified silicone oil lies in a paper machine contamination preventive agent wherein a sidechain is substituted for an amino group or an epoxy group.

(5) The sidechain-type modified silicone oil lies in a paper machine contamination preventive agent wherein the viscosity at 25° C. of the sidechain-type modified silicone oil is 800 cSt or lower.

(6) A press-roll contamination preventive method for directly and continually feeding a paper machine contamination preventive agent to surfaces of press rolls in a state where a wet paper web is supplied in association with the operation of a paper machine, wherein the paper machine contamination preventive agent used in the press-roll contamination preventive method comprises a sidechain-type modified silicone oil or a sidechain both-termini modification silicone oil as a main component.

(7) A dryer-roll contamination preventive method for directly and continually feeding a paper machine contamination preventive agent to surfaces of dryer rolls in a state where a wet paper web is supplied in association with the operation of a paper machine, wherein the paper machine contamination preventive agent used in the dryer-roll contamination preventive method comprises a sidechain-type modified silicone oil or a sidechain both-termini modified silicone oil as a main component.

(8) A canvas contamination preventive method for directly and continually feeding a paper machine contamination preventive agent to a surface of a canvas in a state where a wet paper web is supplied in association with operation of a paper machine, wherein the paper machine contamination preventive agent used in the canvas contamination preventive method comprises a sidechain-type modified silicone oil or a sidechain both-termini modified silicone oil as a main component.

(9) A canvas contamination preventive method for directly and continually feeding a paper machine contamination preventive agent to surfaces of canvas rolls that feed the paper machine contamination preventive agent to a canvas in a state where a wet paper web is supplied in association with operation of a paper machine, wherein the paper machine contamination preventive agent used in the canvas contamination preventive method comprises a sidechain-type modified silicone oil or a sidechain both-termini modified silicone oil as a main component.

According to the present invention, a configuration formed by combining two or more selected from (1) to (5) above and two or more selected from (6) to (9) above may of course be employed.

EFFECT OF THE INVENTION

According to the present invention, a paper machine contamination preventive agent that has high fixability to press rolls and the like is used, thereby enabling a silicone oil to be efficiently fixed to a surface of rolls or the like from the beginning of feed commencement and enabling the surfaces to exhibit releaseability and water-repellent properties.

Accordingly, in particular, the problem of transferring foreign matter to the rolls or the like from the wet paper web in an initial stage of operation commencement can be solved, thereby enabling drawbacks caused by the problem to be reduced.

BRIEF DESCRIPTION OF THE DRAWINGS

FIG. 3 is a schematic view showing a state where a sidechain-substitution type amino modified silicone oil is fed to a roll or the like;

BEST MODE FOR CARRYING OUT THE INVENTION

Embodiment

Figure 1:
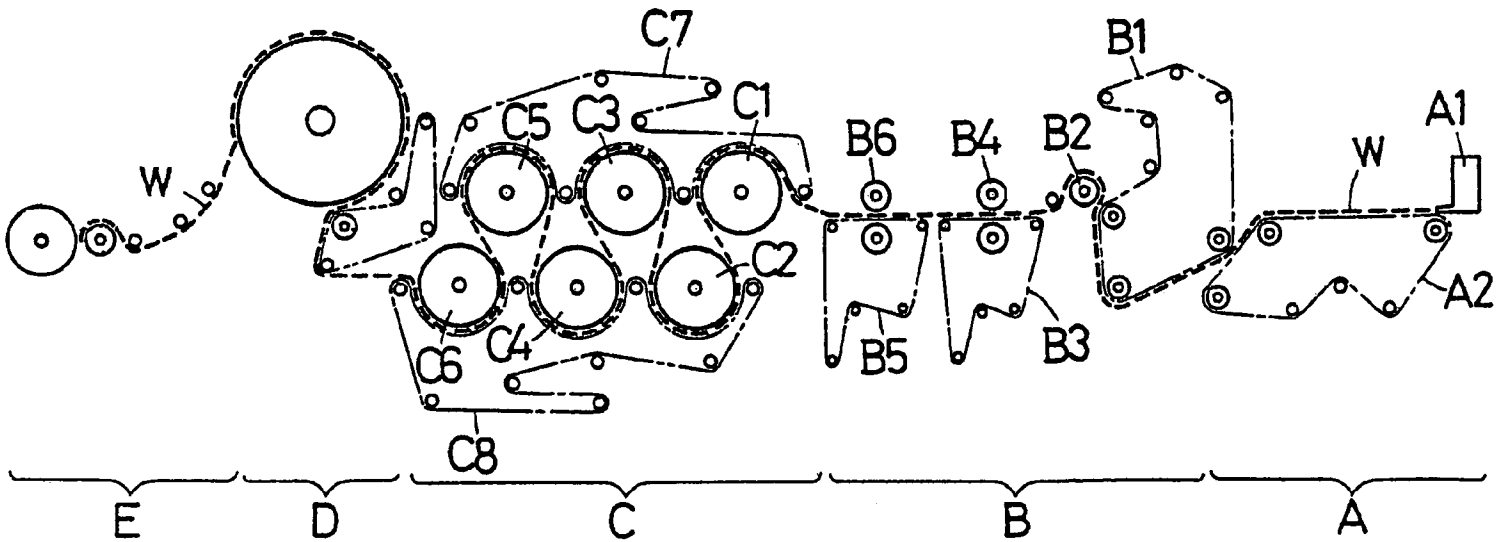
FIG. 1 is a schematic view showing an overall structure of a paper machine.
Figure 2:
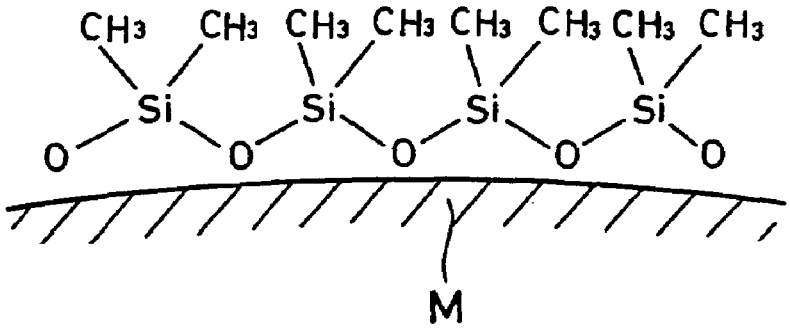
FIG. 2 is a schematic view showing a state where a dimethylpolysiloxane base oil formed as a film with methyl groups outwardly arranged.

A paper machine contamination preventive agent and a paper machine using the agent, according to the present invention will be described below with reference to tables, the drawings, and the like.

First, the paper machine contamination preventive agent.

A feature regarding the paper machine contamination preventive agent according to the present invention lies in that attention is paid to a modified silicone oil among various silicone oils; and more particularly, a sidechain-type modified silicone oil or sidechain both-termini type modified silicone oil (which hereafter will be collectively referred to as a "sidechain substitution type" depending on the case) is selectively employed.

More specifically, the paper machine contamination preventive agent is formed such that the sidechain substitution type modified silicone oil is used as a main component, and water, an emulsifier, and the like are added thereto. The emulsifier is appropriately selected depending on the sidechain substitution type modified silicone oil.

More specifically, the emulsifier is used alone or in combination with nonionic ethers and esters, and the like; anionic organic acids and salts; and cation base and ampholytic emulsifiers.

In addition to the above, of course, oils such as a solid lubricant, metal soap, wax, and mineral oil may be appropriately added, if necessary.

The sidechain substitution type modified silicone oil employed in the paper machine contamination preventive agent according to the present invention will now be described below.

First, Table 2 illustrates a broad classification of silicone oils.

TABLE 2

- Silicone oil
  - Unmodified silicone oil
  - Modified silicone oil
    - Sidechain type
    - Both-termini type
    - Single-terminus type
    - Sidechain both-termini type Silicone oils are broadly classified into unmodified silicone oils (i.e., straight silicone oils), to which dimethylpolysiloxane base oils belong (refer to Table 1), and modified silicone oils having a structure of which the methyl groups are partly substituted by organic functional groups.

Further, the modified silicone oils are classified into four types depending on whether the portion substituted by the organic functional group is a sidechain or terminal, as described below.

The four types are a sidechain type having a sidechain-substituted molecular structure (see Table 3); a both-termini type in which both-termini methyl groups are substituted (see Table 4); a single-terminus type in which one-side terminus methyl group is substituted (see Table 5); and a sidechain both-termini type in which both termini and the sidechain are substituted (see Table 6) (A, A' in the each table represents the organic functional group, and R represents the alkyl group).

TABLE 3

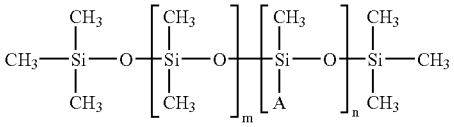

TABLE 4

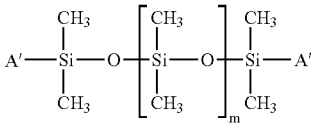

TABLE 5

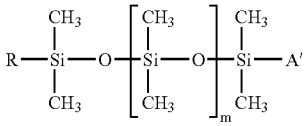

TABLE 6

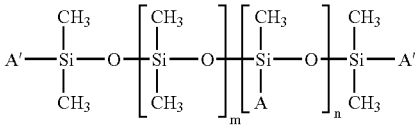

In the structures shown in Tables 3 and 6, n represents that when, for example, n=100, 100 sidechain methyl groups of a dimethylpolysiloxane base oil are substituted at random for organic functional groups A, but it does not refer to a structure where 100 Si atoms to which the organic functional group A is coupled are arranged with the O atoms being sandwiched therebetween in a portion of the chained molecules.

In the paper machine contamination preventive agent of the present invention, the sidechain substitution type (i.e., sidechain type or sidechain both-termini type) modified silicone oil is selectively employed for the reason that the fixability thereof is high with respect to the surface of the roll or the like.

Qualitative considerations will now be focused on the process until the silicone oil fed to the roll or the like is fixed.

First, a case will be described in which an unmodified silicone oil, that is, dimethylpolysiloxane base oil, is fed to the surface of the roll.

In the dimethylpolysiloxane base oil in a normal state (room temperature), the two methyl groups coupled to the Si atom are said to rotate with the Si—O link as the rotation axis in association with the thermal motion at relatively a high amplitude.

Synchronously with this rotation, in the chained molecules, the main-chain siloxane link per se is considered as repeating oscillatory motion in a wavy manner in association with the thermal motion.

As it is considered from the electro-negatives of the molecule-constituting atoms, the O atom of the main chain attracts the Si atom, so that while it has a slightly negative electricity, there is no other portion having a high polarity.

Upon feeding of the dimethylpolysiloxane base oil to a roll or the like, a case can occur in which the O atom of the main chain opposing the roll or the like during the thermal motion is electrostatically attracted to the surface.

However, the thermal motion of the chained molecule causes the O atom to easily detach from the surface of the roll or the like.

Thus, the dimethylpolysiloxane base oil has a low attractive force with respect to the surface of the roll or the like. As such, while the oil is adhered to the roll or the like, it is not fixed thereto, consequently, it easily transfers from the surface of the roll or the like to the wet paper web. Meanwhile, ordinarily, when forming a film, the film is not formed only with the coating of the dimethylpolysiloxane base oil, so that, as described above, a treatment such as burning needs to be performed after coating.

The above points are considered to similarly hold true, even in the case of, for example, a both-termini type modified silicone oil (see Table 4) or single-terminus type modified silicone oil (see Table 5) in the above-described four types of the modified silicone oils.

More specifically, while the terminal methyl group in the giant chained molecules is substituted for the organic functional group, it takes time before the giant molecules are changed in orientation to cause the terminal organic functional group to oppose the surface of the roll or the like, thereby easily allowing transfer to the wet paper web. As such, it cannot be contemplated that the fixability to the surface of the roll or the like is significantly improved in comparison to the unmodified silicone oil (dimethylpolysiloxane base oil).

In contrast, in the sidechain substitution type modified silicone oil, the sidechain organic functional groups can easily be opposed to the surface of the roll or the like in association with the above-described rotational motion of the Si atom rotation with the Si—O link as the axis.

Figure 3:
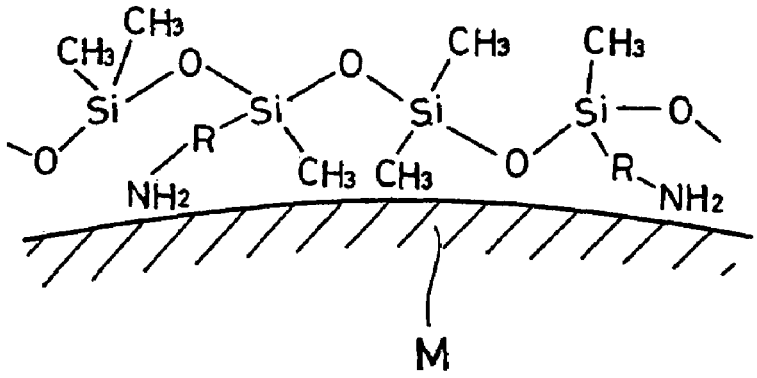

FIG. 3 shows by way of example a case where an amino-modified sidechain-substitution type silicone oil is fed.

More specifically, the chained molecules of the sidechain-substitution type silicone oil are considered to quickly enter the state of exhibiting the anchor effect from the beginning of feeding to a press roll or the like.

In addition, as described above, the sidechain substitution type modified silicone oil is attracted to the surface via many sidechains, so that it does not easily detach from the surface after once having been adhered to the roll or the like.

For this reason, the sidechain substitution type modified silicone oil is considered to have the property of being able to quickly and efficiently adhere to the surface of the roll or the like via the sidechains from the beginning of being fed to the roll or the like, and the property of not easily detaching therefrom—that is, a high fixability.

The oil fixability can be verified by peeling experiment described below, but can be verified by a simpler experiment.

When the dimethylpolysiloxane base oil is coated on an acryl plate and then wiped with tissue papers, the area can be cleaned to a level almost not having any oil remaining. However, when the sidechain-type amino modified silicone oil, for example, is coated on the plate and wiped with tissue paper, although intensively wiped, the oil film remains on the plate.

Thus, it is to be understood that even among the four types of modified silicone oils, the sidechain-type modified silicone oil or sidechain both-end type modified silicone oil having organic functional groups as sidechains is effective as a silicone oil to be employed for the paper machine contamination preventive agent.

Separately from the classification by the portions substituted for the organic functional groups, as described above, modified silicone oils are classified from in terms of reactivity depending on the case.

More specifically, modified silicone oils are broadly classified into two types: the "reactive" type which easily reacts with other molecules, unlike the reactivity with other molecules due to the polarities of the organic functional groups, and the "non-reactive" type which does not easily react with other molecules.

As described above, when considering the role of the sidechain organic functional group causing the anchor effect with respect to the surface to cause the giant chained molecules to be adhered to the roll or the like, the polarity of the organic functional group is preferably higher. Accordingly, the sidechain substitution type modified silicone oil is considered to be preferably reactive.

Reactive sidechain-type modified silicone oils are classified into modified types such as amino-modified, epoxy-modified, carboxyl-modified carbinol-modified, and mercapto-modified types. Sidechain both-termini modified silicone oils are, for example, an amino-alkoxyl modified type having a structure in which the sidechains are substituted for amino groups and both termini are substituted for alkoxyl groups.

Among many, in the sidechain-type modified silicone oils, a modified silicone oil of an amino-modified type substituted sidechain for amino groups (refers to Table 7) or an epoxy-modified type substituted for epoxy groups (refer to Table 8) has a high adhesive property with respect to the roll or the like, and is preferably used from the viewpoints of handling and economical properties (R, R' in the tables represents the alkyl group).

Non-reactive sidechain-type modified silicone oils are classified into, for example, polyester-modified and alkyl-modified types.

TABLE 7

| |
|---|
| $—RNH_2$ or $—RNHR'NH_2$ |

TABLE 8

| |
|---|
| 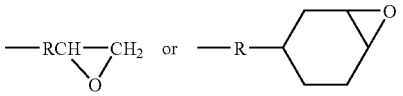 |

Further, among modified silicone oils (such as amino-modified types) formed with the same organic functional groups, there are many oils having different properties such as viscosity (at 25° C.; unit=cSt (centistokes)) and functional group equivalent (unit=g/mol).

As will be described below, the adaptability of a modified silicone oil as a paper machine contamination preventive agent primarily depends on the viscosity and the level of the functional group equivalent almost does not have any influence.

From the viewpoints of canvas-blinding prevention and the like, the modified silicone oil is even more preferable if the viscosity at 25° C. is 800 cSt.

The contamination preventive method for the paper machine using the paper machine contamination preventive agent of present invention will be described below.

The paper machine contamination preventive agent of the present invention is directly or indirectly fed to the press roll or the like of the paper machine to prevent foreign matters from transferring thereto from a wet paper web.

Press Roll Contamination Preventive Method

A press roll contamination preventive method is carried out in such a manner that the paper machine contamination preventive agent of the present invention is fed directly and continually to the surfaces of press rolls to which a wet paper web is supplied by the running of a paper machine.

Figure 4:
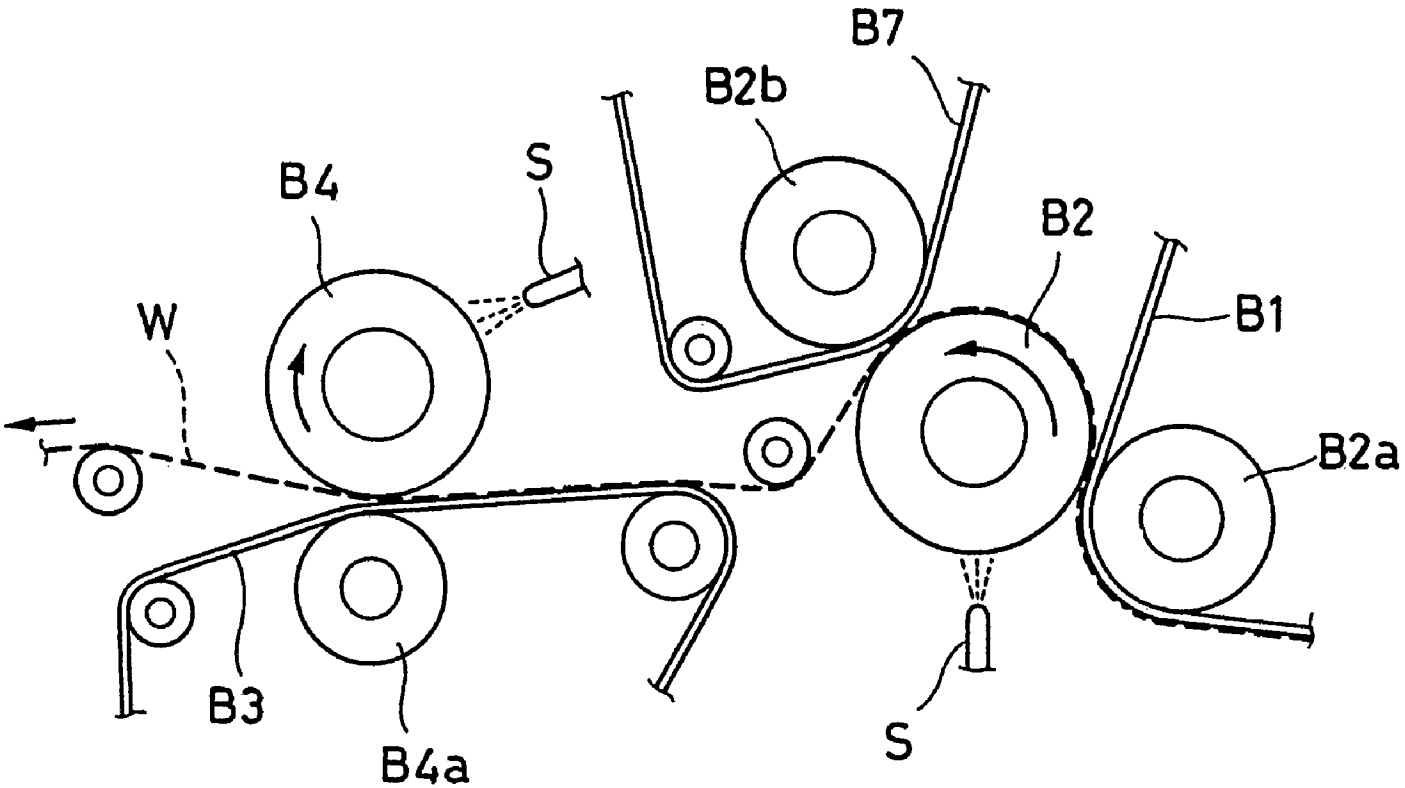
FIG. 4 is a view showing in detail a portion of the press part of the paper machine shown in FIG. 1.

FIG. 4 is a view showing in detail a portion of the press part B of the paper machine shown in FIG. 1.

In association with the running of the paper machine, the wet paper web W overlaid on the felt B1 is supplied to a pair of press rolls B2 and B2*a* and is dewatered by being nipped therebetween.

Thereafter, the wet paper web W moves while being kept in contact with the surfaces in synchronization with the rotation of the press roll B2 and is supplied by being overlaid on a felt B7 to a pair of press rolls B2 and B2*b*, and is further dewatered by being nipped therebetween.

Then, the wet paper web W leaves the press roll B2, is then supplied to a pair of press rolls B4 and B4*a* by being overlaid on a felt B3 and further dewatered by being nipped therebetween.

According to the present invention, the paper machine contamination preventive agent is fed directly and continually from a spray nozzle S onto the surface of the press rolls B2 and B4 supplied with the wet paper web and rotated.

Figure 5:
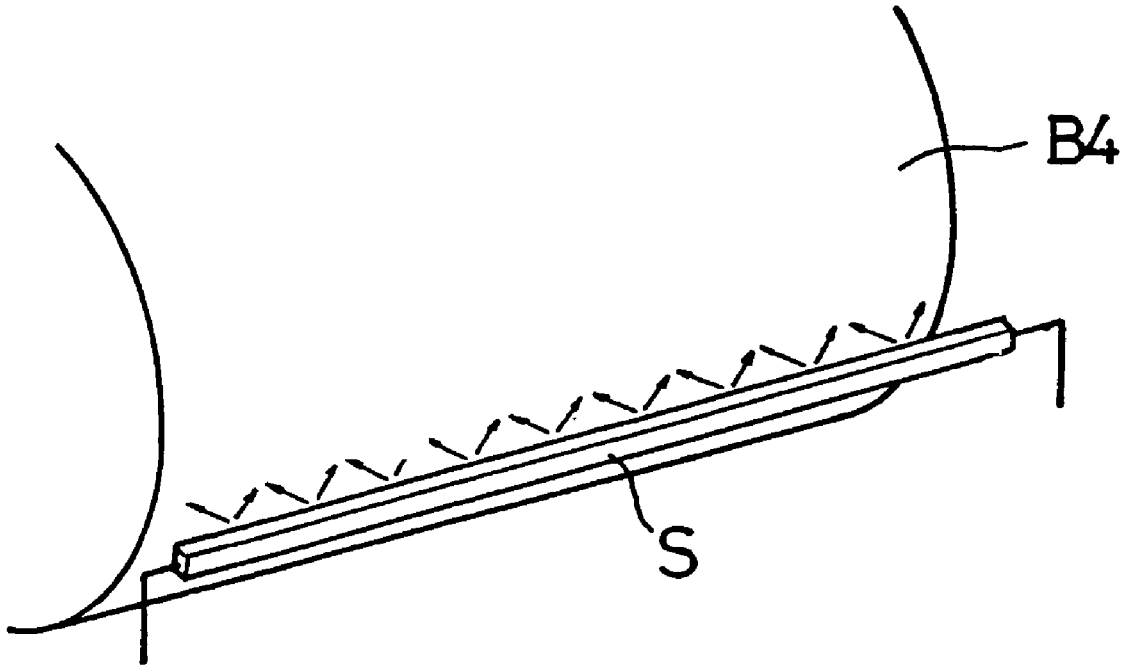
FIG. 5 is a view showing a state in which a paper machine contamination preventive agent is fed to a press roll by a shower method.

Needless to say, for example, as shown in FIG. 5, the paper machine contamination preventive agent is sprayed using a shower covering the full roll width, or is sprayed while one or more spray nozzles S (not shown) are moved leftward and rightward.

Of course, the number of spray nozzles, spray method, and the like are appropriately determined in accordance with, for example, the paper machine performance and papermaking conditions.

Of course, doctors for dislodging foreign matters on the surface may be disposed at front and rear positions of the spray nozzle S or the shower.

After having been sprayed in this manner, the sidechain-type or sidechain both-termini type modified silicone oil contained in the paper machine contamination preventive agent is quickly fixed on the surfaces of the press rolls through the above-described processing.

Consequently, the roll surfaces are each quickly imparted with the releaseability and water-repellent properties, thereby enabling foreign-matter transfer from the wet paper web to be prevented from the beginning of feeding.

Dryer Roll Contamination Preventive Method

Figure 6:
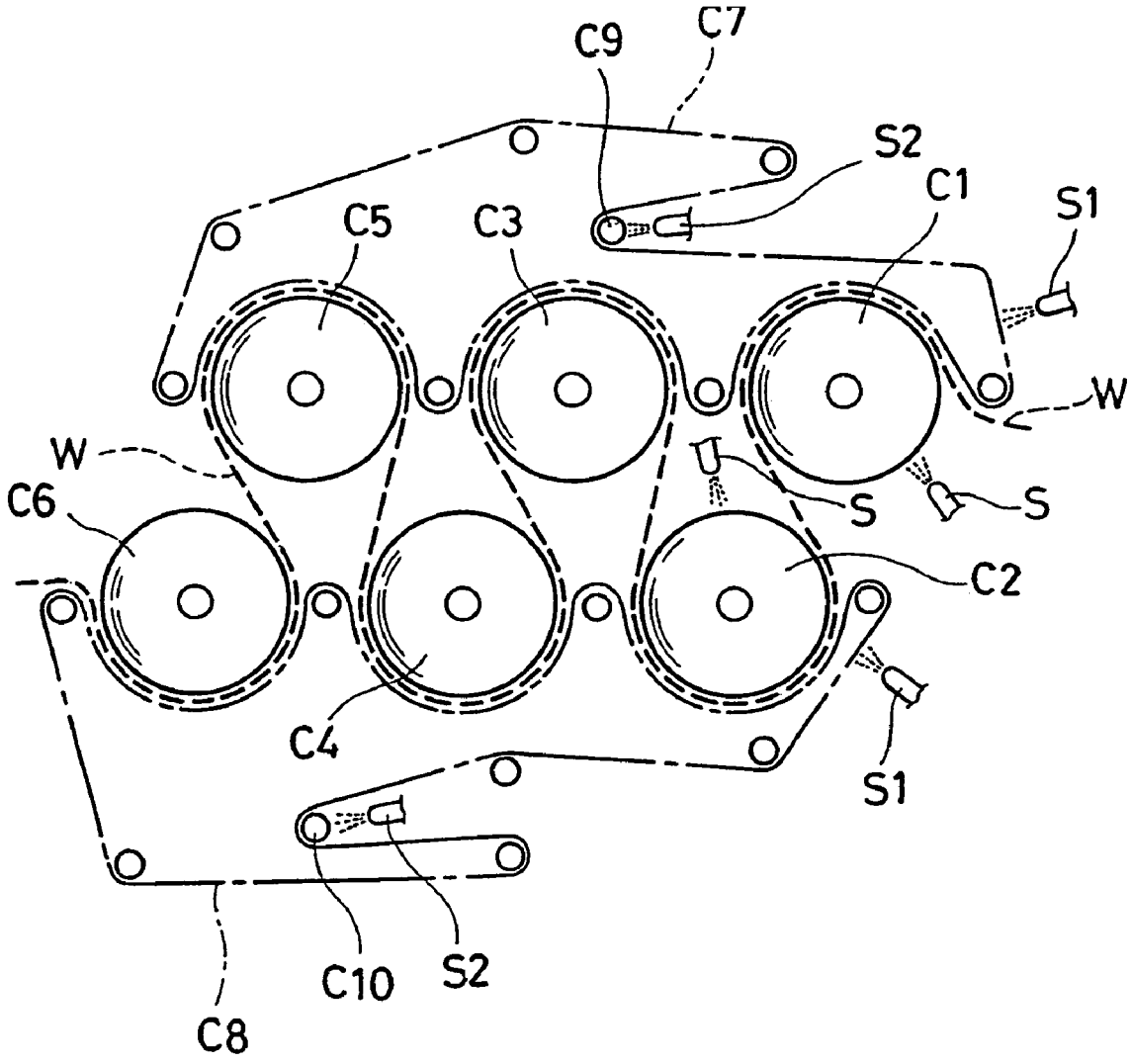
FIG. 6 is an enlarged view of a dryer part of the paper machine shown in FIG. 1.

FIG. 6 is an enlarged view of the dryer part C of the paper machine shown in FIG. 1.

In the dryer part C, the wet paper web W is supplied between a dryer roll C1 or the like and a canvas 7, and the heat of the dryer roll heated while being pressed by the dryer roll under pressure of the canvas is absorbed.

Press contact is repeated with several or several tens of dryer rolls, whereby gradual drying advances.

Similar to the case of the press rolls, the modified silicone oil can be fed in the manner that the paper machine contamination preventive agent is sprayed directly and continually to the surfaces of the dryer rolls being supplied with the wet paper web from the spray nozzle S moving leftward and rightward.

Upon feeding of the oil to the dryer roll of a highest upstream one of a group of dryer rolls in the dryer part, part of the oil transferred to the wet paper web from that dryer roll transfers to lower roller surfaces. Consequently, efficient contamination prevention can be performed for the group of dryer rolls.

Canvas Contamination Preventive Method

The canvas presses the wet paper web to the dryer roll heated as described above.

Concurrently, water vapor produced from the wet paper web in evaporation caused by the dryer roll heat is diffused to the outside through weave texture spacings (that is, canvas mesh), so that the processing plays the same role as that drying the wet paper web.

Thus, similar to the above dryer roll, the canvas also comes in direct contact with the wet paper web, to thereby transfer foreign matters from the wet paper web.

The contamination preventive agent being fed to the canvas prevents a case where foreign matters transferred from the wet paper web blinds the canvas mesh, thereby deteriorating the drying efficiency and causing drawbacks due to a failure in drying the wet paper web.

Primarily, two feeding methods are used to feed the paper machine contamination preventive agent to the canvas.

The first method directly feeds the agent to the canvas.

With reference to FIG. 6, the method uses the shower S1 covering the full width of the canvas to spray the paper machine contamination preventive agent onto the surface of the canvas in a position immediately before a position where the canvas C7 together with the wet paper web W come in contact with the dryer roll C1 (a similar operation is performed for the case with the canvas C8).

Figure 7:
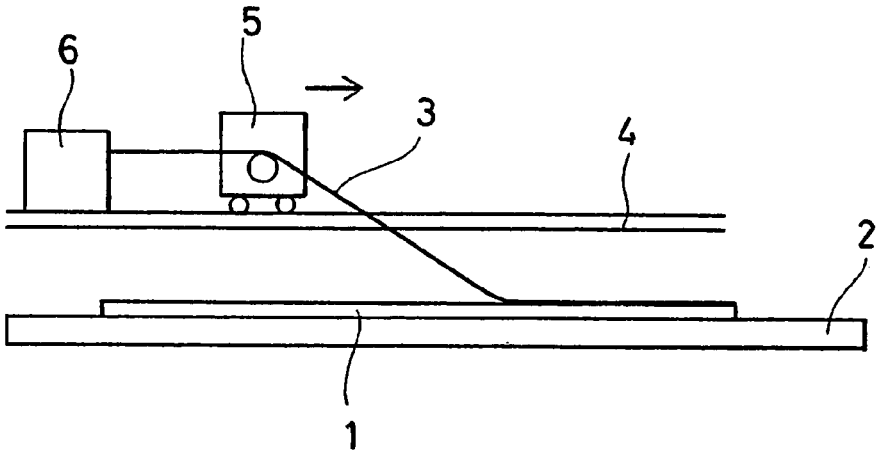
FIG. 7 is a view showing a state where the paper machine contamination preventive agent is sprayed to an out roll.

The second method feeds the agent to a canvas roll guiding the canvas and thereby provides the canvas with a tension, particularly, to out roll C9 or C10 provided in contact with an outer surface of the canvas, thereby causing the oil to transfer to the surface of the canvas from the roll surface (refer to FIG. 7).

Cases can occur in which foreign matters, such as fine fibers transferred from the wet paper web to the canvas, is delivered to the out roll, thereby adhesively accumulating on the roll surface.

The method is advantageous in that the accumulation of foreign matters on the out rolls can be concurrently inhibited.

An example will now be described below.

The present invention is of course not limited by the example.

EXAMPLES

Various experiments were performed for the various target silicone oils and the experiments will be described below with reference to practical examples.

An emulsion (containing the paper machine contamination preventive agent of the present invention) was prepared as shown below.

| | |
|---|---|
| Silicone oil (sample) | 10 wt. % (weight %) |
| Emulsifier (Emulgen 109P (supplied by Kao Corp.; polyoxyethylene lauryl ether, nonion base)) | 2 wt. % |
| Water | 88 wt. % |
| Total | 100 wt. % |

① (Peeling Experiment 1)

Figure 8:
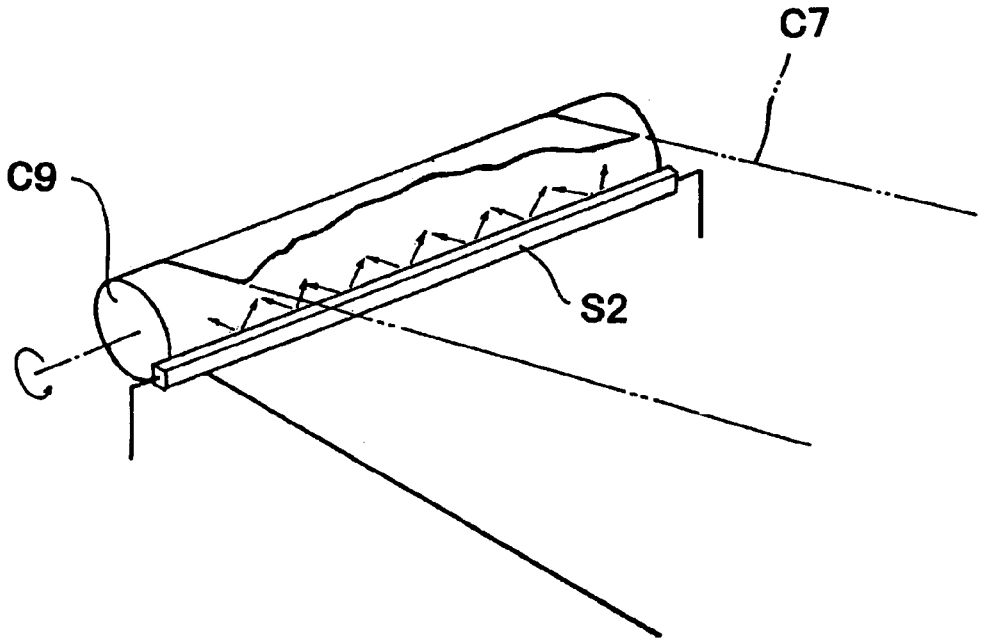
FIG. 8 is a view schematically showing a major portion of a peeling experiment apparatus.

An emulsion prepared with various silicone oils was coated on an acryl plate prepared for the surface of the roll or the like and the operations of pasting-peeling of an adhesive tape used for the wet paper web containing foreign matters were repeatedly performed, and the fixabilities of the various modified and unmodified silicone oils (refer to Table 2). A major portion of an experiment apparatus is shown in FIG. 8.

The emulsion, 1, was uniformly spray-coated three times (about 10 g) in 5 cm×100 cm areas of the surface of the acryl plate 2.

Over the areas, a polyester adhesive tape 3 (Brand No. 553; Width=5 cm; Nichiban Co., Ltd.) was adhered, and pressed by a rubber roller (5 kg/cm$^2$; emulsion film thickness=about 60 μm) to be intensively adhered.

A movable carriage 5 was run on a rail 4 along the right direction (arrowed direction) as viewed in the drawing, and a peeling force exerted when the adhesive tape 3 was peeled off at a peeling speed of 3 m/s and a peeling angle of 30° was measured using a measuring instrument.

Subsequently, a new adhesive tape was adhered to the same portion without recoating the emulsion, pressed by a gum roller to be intensively adhered, and then peeled off. The experiments were thus repeatedly performed, and the peeling force was measured each time.

Figure 9:
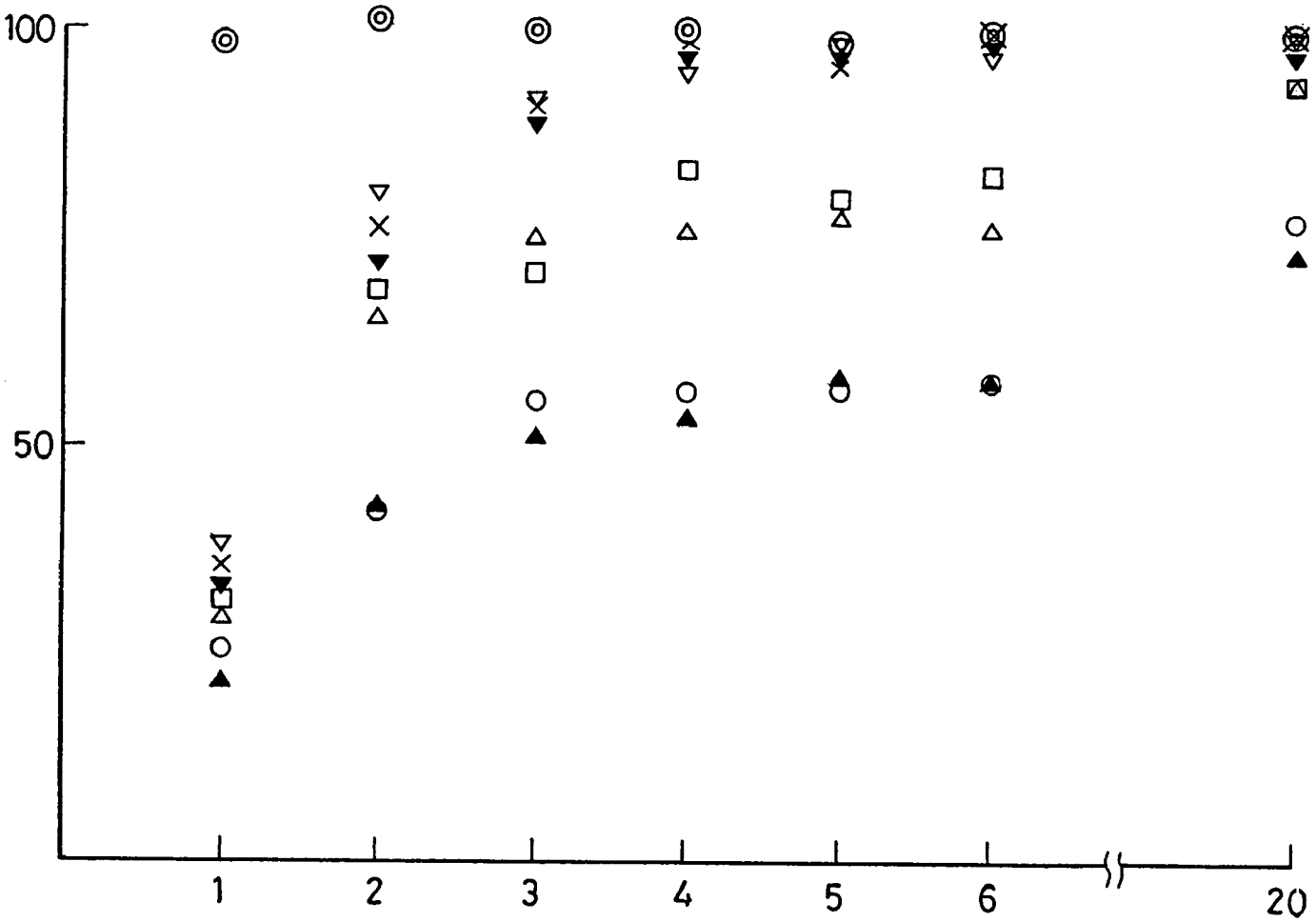
FIG. 9 is a graph showing measurement results of ① Peeling Experiment 1.

Firstly, the results of the peeling experiments performed with the emulsion 1 prepared using silicone oils shown in Table 9 are shown in FIG. 9.

FIG. 9 shows the results by plotting the conversion values of the individual sample measurement values in the case that an average value of 20 measurement values of peel experiments with respect to blanks was set to 100.

TABLE 9

| Sample | Product name | Type | viscosity | Symbol |
|---|---|---|---|---|
| 1 | KF96-350 | Unmodified (Dimethyl) | 350 | X |
| 2 | KF-860 | Sidechain-type amino modified (reactive) | 250 | ○ |
| 3 | KF-410 | Sidechain-type methylstyl modified (non-reactive) | 900 | Δ |
| 4 | KF-413 | Sidechain-type alkyl modified (non-reactive) | 190 | □ |
| 5 | KF-8008 | Both-termini type amino modified | 450 | ∇ |
| 6 | X-22-173DX | Single-terminus type epoxy modified | 65 | ▼ |
| 7 | KF-8001 | Sidechain both-termini amino-alkoxyl modified | 250 | ▲ |
| Blank | — | — | — | ◎ |

Units of viscosity: cSt
Any of the products is supplied by Shinetsu Kagaku Kogyo K.K.

Measurement Results

Clearly from the experiments, behaviors with respect to the peeling are broadly grouped into three types by the type of silicone oil.

The first type is an unmodified, both-termini type modified, and single-terminal type modified silicone oil group. This group quickly approaches the measurement value in the blank case as peeling is repeated.

The second type is a sidechain type modified (reactive) and sidechain both-termini modified silicone oil group. This group behaves such that the peeling force increases in an initial stage, but the increase is discontinued after several times of peeling and the peeling force becomes substantially constant, and the force does not increase up to the measurement value in the blank case even when 20 times of peeling are repeated.

The third type is a sidechain type modified (non-reactive) silicone oil group that indicates an intermediate behavior between the first and second silicone oil groups.

Evaluations

In the overall view, in the case of any of the samples, the force required for peeling is initially low, and the peeling force increases after several times of peeling.

This is considered to indicate that residues of water, silicone oils, and the like in the emulsion are removed by the adhesive tape after the initial several times of peeling.

In the case of the first-type (unmodified, both-termini type modified, and single-terminal type modified) silicone oils, from the fact that the oils each indicate substantially the same peeling force as the peeling force for the blank after four or five times of peeling, the oil is easily peeled off by the adhesive tape.

Accordingly, the silicone oils of this type are considered insufficient in fixability.

In the case of the second-type (sidechain type (reactive) and sidechain both-termini type) modified silicone oils, the peeling forces are maintained at lower values than the measurement value in the blank case. From this, it was known that part of the fed modified silicone oils adhered to the acryl plate and was not peeled off, and the oils exhibited releaseability and water-repellent properties.

That is, it is concluded that the reactive sidechain type and sidechain both-end type modified silicone oils are excellent in fixability.

In the case of the third-type sidechain type (non-reactive) modified silicone oils, it was known that although not at the levels of the sidechain type oils, at least part thereof was not peeled off from the surface of the acryl plate, and it maintained certain levels of releaseability and water-repellent properties (that is, the fixability was relatively good).

From the above-described experiment results, the sidechain-type modified silicone oils (including the non-reactive types) and sidechain both-end type modified silicone oils are considered suitable for the paper machine contamination preventive agent of the present invention. For this reason, experiments described below were not performed for the both-termini and single-terminus type silicone oils (for the unmodified silicone oils, experiments were performed in the form of target experiments).

In addition, although not explicitly indicated, it was recognized that the non-reactive sidechain-type modification silicone oils (corresponding to Δ and □ in FIG. 9) indicate similar behaviors as the reactive sidechain-type modified silicone oils, even in the embodiments described below.

As such, in the following description, to avoid complexity, the oils of the reactive and non-reactive sidechain-type modification silicone oils will not be distinguished, but will be collectively referred to as "sidechain-type modified silicone oils."

② Peeling Experiment 2

To investigate that what relationships the viscosities and functional group equivalents of silicone oils have with the fixabilities, peeling experiments similar to above were performed for the sidechain type and sidechain both-termini modification silicone oils having various viscosities and functional group equivalents.

In the experiments, emulsions prepared using samples B, E and I shown in Table 10, and the individual peeling forces were measured.

TABLE 10

| Sample | Structure classification | Modified type | Product name | Viscosity (cSt) | Functional group equivalent (g/mol) | Symbol |
|---|---|---|---|---|---|---|
| A | Sidechain type | Amino modified | KF-860 | 250 | 7600 | ○ |
| B | | | KF-880 | 650 | 1800 | ■ |
| C | | | KF-8004 | 800 | 1500 | |
| D | | | KF-8005 | 1200 | 11000 | |
| E | | | KF-861 | 3500 | 2000 | ◆ |
| F | | Epoxy modified | X-22-2000 | 190 | 620 | |
| G | | | KF-101 | 1500 | 350 | |
| H | Terminal type | Amino-alkoxyl modified | KF-8001 | 250 | 1900 | ▲ |
| I | Sidechain type | | KF-862 | 750 | 1900 | ◇ |
| J | Non-modified | — | KF96-350 | 350 | — | X |

Any of the products is supplied by Shinetsu Kagaku Kogyo K.K.

Measurement Results

Figure 10:
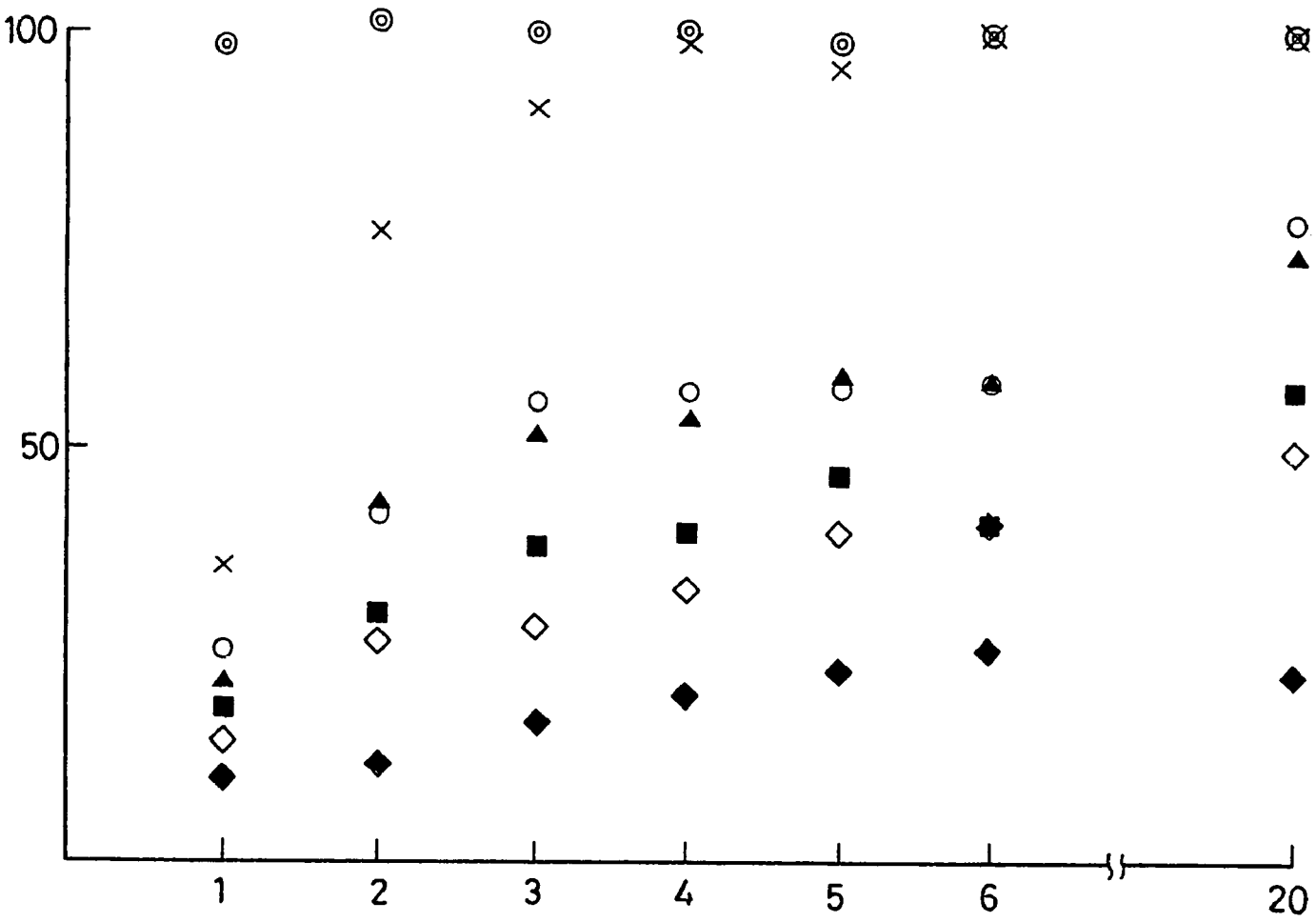
FIG. 10 is a graph showing measurement results of ② Peeling Experiment 2.

FIG. 10 is a graph created by plotting the conversion values of the peeling forces of emulsion and blanks prepared using samples A, H, and J, measured in ① Peeling Experiment 1, in addition to those of the aforementioned samples B, E and I (similar to the above-described experiments, an average value of 20 measurement values with respect to the blank was set to 100).

Evaluations

In the graph in FIG. 10, the forces required for peeling are lower as are the viscosities in the sidechain type and sidechain both-termini modification silicone oils, so that it is indicated that the fixabilities to the acryl plate are higher as the viscosities are higher.

In addition, it is also indicated that the fixability does not rely on the level of the functional group equivalent.

Although not actually illustrated, in experiments using an emulsion prepared from the sample D (viscosity=1200 cSt) having the intermediate viscosity between the samples B and E, individual measurement values were substantially within a range of measurement values of samples B and E.

Although not illustrated, in the case of unmodified silicone oils (dimethylpolysiloxane base oils), even when experiments were performing using products having various viscosities (for example, KF96H-100000, viscosity=100000 cSt, supplied by Shientsu Kagaku Kougyou K.K.), the tendency as described above was not observed and, even when the viscosity was increased, the fixability was not improved.

③ Feeding Experiments to Press Rolls

Experiments described hereunder were performed by feeding emulsions prepared from the samples A to J shown in Table 10 to a practical paper machine.

In addition, the used paper machine was dedicated to manufacture corrugated-cardboard core material paper, and the experiments were performed under the following papermaking conditions:

Papermaking Conditions

Paper machine: Ultra Former (supplied by K.K. Kobayashi Seisakusho)

Products: Normal cores

Mass per unit area: 160 g/m$^2$

Rate per second: 350 m/min

Paper width: 4 m

In the experiments, the emulsions prepared from the samples A to J shown in Table 10 were sprayed on press rolls of the paper machine and the generated amounts of dirty foreign matter lodged out by a doctor from the surfaces of the press rolls after the passage of four hours from the start of spraying were compared.

Actually, since the concentration is too high, the emulsions were diluted 500 times with water, and the diluted liquid was sprayed by a shower method at a rate of 5 litters/min. (10 cm$^3$/min. on an emulsion basis).

Each time the experiment was completed, the press rolls were cleaned and silicone oils and the like were removed from the surfaces thereof.

Experiment Results

When the sidechain type and sidechain both-termini modification silicone oils of samples A to I were used, the generated amounts of dirty foreign matters in the individual sample cases were not significantly different from one another and were about 10-20 g.

On the other hand, in the case of the unmodified silicone oil of sample J, the generated amount of dirty foreign matters after the passage of the same time was 171 g on the average (average of values obtained in three experiments).

Dirty foreign matters in the case of any of the samples A to J were primarily gum pitches and fine fibers carried with the wet paper web.

Additional Experiments

Since the generated amount of dirty foreign matters in the case of sample J (the unmodified silicone oil) was large, the emulsion concentration was increased and additional experiments were performed therewith.

For diluted liquids, one prepared by a 250-times dilution of the emulsion and one prepared by a 125-time dilution of the emulsion were used and the diluted liquids were each sprayed at a rate of 5 litters/min. (on an emulsion basis, the 125-times diluted liquid was sprayed at a rate of 20 cm$^3$/min. and the 250-times diluted liquid was sprayed at a rate of 40 cm$^3$/min.).

According to the results, in the case of the 250-times diluted liquid, the generation amount of dirty foreign matters was 157 g on average (average of three experiments).

In the case of the 125-times diluted liquid, while the generation amount of dirty foreign matters was 149 g, a tendency for deteriorating the glue adhesion with respect to the manufactured core material paper was observed at a corrugator, so that the additional experiments was discontinued after one experiment.

Evaluations

The results of the experiments clearly indicated the differences in the fixabilities of the sidechain type and sidechain both-termini modification silicone oils in the initial stages at the start of spraying.

When these results are taken into account together with the above-described experiment results, in the cases of the sidechain type and sidechain both-termini modification silicone oils, the oils were fixed on the surfaces of the press rolls and certain levels of releaseability and water repellent properties were indicated. Consequently, the transfer of foreign matters from the wet paper web were effectively inhibited.

In the case of the unmodified silicone oil, it was known that the transfer of gum pitches and the like from the wet paper web was not effectively inhibited to the level of the sidechain-type modified silicone oil.

Further, in the additional experiments, the transfer of foreign matters from the wet paper web can be reduced to a certain level if the feed amounts are increased, however, the level does not reach the level of the sidechain-type modified silicone oil.

Further, the results indicate that the oils are transferred from the surfaces of the press rolls to the wet paper web.

Accordingly, when the results of the above-described peeling experiments are together taken into consideration, although the unmodified silicone oil is fed to the surfaces of the press rolls, the oil easily transfers from the surfaces. As such, it cannot be said that steady oil layers having the releaseability and water repellent properties are formed on the surfaces and the transfer of gum pitches and the like from the wet paper web cannot be always effectively inhibited.

④ Feeding Experiments to Dryer Rolls

Similar to the above-described feeding experiments ③, the emulsions prepared from the samples A to J shown in Table 10 were sprayed on dryer rolls of the paper machine, and the generation amounts of dirty foreign matters lodged out by a doctor from the surfaces of the dryer rolls were compared.

In the experiments, the emulsions were used without changing the concentrations and were sprayed at a rate of 10 cm$^3$/min. on the surfaces of the dryer rolls from one spray nozzle being moved leftward and rightward.

Experiment Results

When the sidechain type and sidechain both-termini modification silicone oils of samples A to I were used, the generation amounts of dirty foreign matters after the passage of four hours from the start of spraying were 10 g in the individual sample cases.

On the other hand, in the case of the unmodified silicone oil of sample J, the generation amount of dirty foreign matters after the passage of the same time was 104 g on average (average of the values obtained in three experiments).

Similar to the case of the press roll, the dirty foreign matters in the case of any of samples A to J were primarily gum pitches and fine fibers carried with the wet paper web.

Evaluations

Similarly to the above experiments ③, the experiment results are considered to clearly indicate differences in the fixabilities of the sidechain type and sidechain both-termini modification silicone oils and the unmodified silicone oil in initial stages of the start of spraying.

⑤ Feeding Experiments to Canvas

In the experiments, the emulsions prepared from the samples A to J shown in Table 10 were diluted and directly sprayed on the canvas in the dryer part of the paper machine, and the states of transfer of foreign matters to the canvas.

The emulsions were diluted 150 times with warm water of 60° C. and sprayed on the canvas by using a shower having 40 nozzles arranged at a 100 mm pitch at a total rate of 1.5 litters/min. (10 cm$^3$/min. on an emulsion basis) in substantially 10 days.

Experiment Results a. Blinding of Injection Outlets of Spray Nozzles

During the experiments, when the sample I (sidechain both-termini type) was used, reductions in spray amounts from 12 to 40 nozzles were observed from substantially the fifth day after the start of spraying, whereby dirt began to adhere to corresponding portions of the canvas.

Thereafter, on substantially the seventh day, since eight nozzles were completely blocked, the experiments were discontinued.

In addition, in the case of sample H, reductions in spray amounts from 10 of the 40 nozzles were observed from substantially the seventh day to corresponding portions of the canvas. In addition, on substantially the ninth day, five nozzles were blocked, so that the experiments were discontinued.

In the cases of samples I and H, after the discontinuation of the experiments, when the spray device was opened, gum-like sample oil deposits were observed inside the injection outlets of about 30 of the 40 nozzles in sample I and about 25 of the 40 nozzles in sample H.

As such, for samples H and I, the experiments were aborted upon the observation.

For samples A to G and J, no reductions in the spray amounts from the nozzles were observed in substantially 10 days.

However, after the experiments using the sample E, when the spray device was opened, there were about 10 nozzles in each of which a slight oil mass was recognized inside the injection outlets.

b. Oil Laminate on Out Rolls

In the cases of samples H and I, upon the abortion of the experiments, when the surface of an out roll was visually checked, in each of the cases, a laminate (thickness=about 0.2 to about 0.5 mm) of a gum-like substance originated by the silicone oil was observed.

In the cases of samples A to G, after substantially 10 days, these laminates were not recognized, but a below-described deposition of foreign matters originated by the wet paper web was observed.

Evaluations on a and b

The samples H and I, for example, are both the sidechain both-termini type modified silicone oils and have alkoxyl groups for both termini ($C_nH_{2n+1}O$—)(sidechain=amino group).

Generally, a modified silicone oil having the alkoxyl group for the terminus is known to abruptly increase the reactivity when the alkoxyl group is changed to a hydroxyl group (—OH) by being, for example, heated and subjected to hydrolysis.

In the feeding experiments ⑤ to the canvas, since each sample was diluted with warm water of 60° C., the reaction might have occurred. As such, when spraying the sidechain both-termini type modified silicone oil, it is considered that the emulsion should not be heated so much.

In the feeding experiments to, for example, the out roll (③) and dryer roll (④) (the emulsions in the experiments were not heated), the confirmation experiments were performed by spraying the emulsions prepared from the samples H and I, diluted liquids thereof, and the like for substantially 10 days. During the experiments, no blinding of spray nozzles was observed.

c. Sticking Phenomenon

During the experiments ⑤, in samples D, E and G, cases in which the wet paper web is pulled by the canvas, i.e., a so-called "sticking phenomenon" were observed after the passage of substantially eight days or so.

However, in samples A, B, C, F, and J, no such phenomenon was observed.

Evaluations

As described below, similar to where samples A, B, C and F were sprayed, while fine fibers, gum pitches, and the like were slightly observed on the surface of the canvas on which the samples D, E and G were sprayed, a particularly large amount of transfer was observed.

As such, these phenomena cannot easily be considered to have been caused by foreign matters transferred from the wet paper web.

In the above-described peeling experiments, since the fixabilities to the acryl plate were higher as the viscosities were higher, over-fixing of the oil to the surface of the canvas has occurred in each of the cases of the high-viscosity samples D (1200 cSt), E (3500 cSt) and G (1500 cSt). This is considered to have occurred because the oil over-fixed on the canvas pulled the wet paper web.

Accordingly, for a sidechain-type modification silicone to be employed for the paper machine contamination preventive agent that will be fed to the canvases, samples A, B, C and F, i.e., a sidechain-type modified silicones oil having a viscosity of 800 cSt or higher is preferable.

d. Transfer of Foreign Matters to Canvas, etc.

After the diluted liquids of the emulsions of samples A to G and J were directly fed to the canvas under the above-described conditions for 10 days, the transfer states of foreign matters to the canvas surface were visually compared.

In addition, the air permeability of the canvas was measured using an air-permeability measurement device.

Further, the adhesion of oil, foreign matters and the like to the out roll was visually observed.

In the cases of the sidechain-type modified silicone oils of the samples A to G, transfer of fine fibers, gum pitches and the like to the canvas surface was slightly observed. However, the air permeabilities were almost not different from those in pre-feeding states.

When the out roll was observed, the surface of the out roll was found glossy in all the sample cases. However, such laminates of silicone-oil originated gum-like substances as observed in the cases of samples H and I were not observed.

In the case of the unmodified silicone oil of sample J, transfer of foreign matters such as fine fibers and gum pitches were observed and the air permeability was reduced by about 20%.

Further, the deposition of mixtures of oils, fine fibers, gum pitches and the like, each having a diameter of about 10 mm were observed at a pitch of 30-50 mm on the overall surface of the out roll.

Evaluations

In the case of the sidechain-type modified silicone oil, the transfer of foreign matters to the canvas surface was slight and the blinding of the canvas was almost not caused in at least substantially 10 days.

In comparison, it is known that, in the case of the unmodified silicone oil, the blinding of the canvas already started during substantially 10 days, and in addition, the deposition of oils, foreign matters and the like to the out roll started during feeding for substantially 10 days.

Accordingly, when the sidechain-type modified silicone oil is employed for the paper machine contamination preventive agent, it can be considered that at least the number of cleaning operations for the canvas can be reduced to thereby enable the production efficiency to be improved.

Summary of Experiments

In the total view of the above-described evaluations, at least when the emulsions and the diluted liquids (paper machine contamination preventive agent) thereof can be fed without being heated (that is, in the event of feeding to the press rolls, dryer rolls, and the like), the sidechain type and sidechain both-termini modification silicone oils as used in the above-described experiments exhibited more excellent results than the dimethylpolysiloxane base oil (unmodified silicone oil) in at least the two viewpoints, namely, the fixability to the roll and transfer inhibition capability for foreign matters from the wet paper web.

On the other hand, when the emulsions and the diluted liquids thereof are to be heated (for feeding to the canvas), the sidechain both-termini type modified silicone oil having at least alkoxyl groups for both termini, a case can occur in which the alkoxyl group undergoes hydrolysis and thereby abruptly increases the reactivity, thereby, for example, causing the spray nozzles to be blinded and causing a gum-like film to be formed on the surface of the out roll. Further, the sidechain-type modified silicone oil having a viscosity of 800 cSt or higher can cause over-fixing to the canvas, thereby potentially leading to the sticking phenomenon.

However, it was found that the sidechain-type modified silicone oil at least having a viscosity of 800 cSt or lower had better results than the dimethylpolysiloxane base oil (unmodified silicone oil) in both fixability to the roll and the transfer inhibition capability for foreign matters from the wet paper web.

Further, if the above-described problems can be solved by, for example, appropriate adjustment of the heating temperature of the emulsion in the spray nozzle and the feed amount to the canvas, even the sidechain both-termini modification silicone oil and the sidechain-type modified silicone oil having a viscosity of 800 cSt can of course be used for the paper machine contamination preventive agent as silicone oils which are more effective than the dimethylpolysiloxane base oil.

As above, while the present invention has been described, the invention is not limited to the embodiments and various other modifications may of course be made without departing the essentials of the present invention.

For example, if gum-like substances are not formed, two or more sidechain-type modified silicone oils, sidechain both-termini modification silicone oils, and the like may be mixed and used, and they may be used in the form of mixtures with the unmodified silicone oil.

The spray method is not limited to the method employed in the embodiment, but may be appropriately selected in accordance with, for example, papermaking conditions of a paper machine being used.

Furthermore, the sidechain-type modified silicone oil, sidechain both-termini modification silicone oil, and the like may be fed in such a different method as that feeds part of the oil passes through the inside of a liquid vessel during the roll rotation.

INDUSTRIAL APPLICABILITY

While the present invention relates to a paper machine contamination preventive agent and a contamination preventive method using the same, the invention can be adapted to overall papermaking technical fields without departing from the principles of the invention, thereby enabling similar advantages and effects to be expected.

The invention claimed is:

1. A dryer-roll contamination preventive method comprising the steps of:

feeding directly and continuously a paper machine contamination agent comprising a modified silicone oil in which only a sidechain is substituted with an amino- or an epoxy-containing organic functional group to surfaces of dryer rolls of a paper machine and passing a wet paper web through the press rolls of the paper machine.

2. A canvas contamination preventive method comprising the steps of:

feeding directly and continuously a paper machine contamination agent comprising a modified silicone oil in which only a sidechain is substituted with an amino- or an epoxy-containing organic functional group to a surface of a canvas of a paper machine and contacting a wet paper web with the surface of the canvas of the paper machine.

3. A canvas roll contamination preventive method comprising the steps of:

feeding directly and continuously a paper machine contamination agent comprising a modified silicone oil in which only a sidechain is substituted with an amino- or an epoxy-containing organic functional group to surfaces of canvas rolls of a paper machine and passing a wet paper web through the canvas rolls of the paper machine.

4. A press-roll contamination preventive method comprising the steps of:

feeding directly and continuously a paper machine contamination agent comprising a modified silicone oil of formula (1), wherein sidechain A is substituted with an amino- or epoxy-containing organic functional group, to surfaces of press rolls of a paper machine and passing a wet paper web through the press rolls of the paper machine (1)

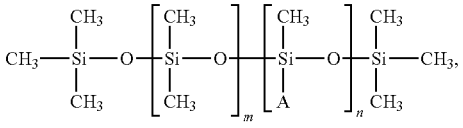

wherein m and n are each an integer.

5. A press-roll contamination preventive method according to claim 4, wherein sidechain A is substituted with an epoxy-containing organic functional group.

6. A dryer-roll contamination preventive method comprising the steps of:

feeding directly and continuously a paper machine contamination agent comprising a modified silicone oil of formula (1), wherein sidechain A is substituted with an amino- or epoxy-containing organic functional group, to surfaces of dryer rolls of a paper machine and passing a wet paper web through the dryer rolls of the paper machine (1)

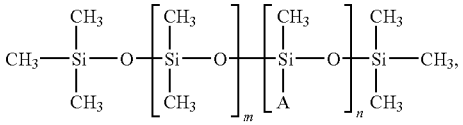

wherein m and n are each an integer.

7. A dryer-roll contamination preventive method according to claim 6, wherein sidechain A is substituted with an epoxy-containing organic functional group.

8. A canvas contamination preventive method comprising the steps of:

feeding directly and continuously a paper machine contamination agent comprising a modified silicone oil of formula (1), wherein sidechain A is substituted with an amino- or epoxy-containing organic functional group, to a surface of canvas of a paper machine and contacting a wet paper web with the surface of the canvas of the paper machine (1)

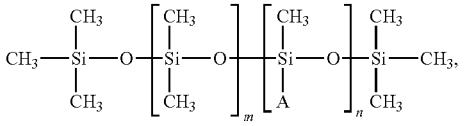

wherein m and n are each an integer.

9. A canvas contamination preventive method according to claim 8, wherein sidechain A is substituted with an epoxy-containing organic functional group.

10. A canvas roll contamination preventive method comprising the steps of:

feeding directly and continuously a paper machine contamination agent comprising a modified silicone oil of formula (1), wherein sidechain A is substituted with an amino- or epoxy-containing organic functional group to surfaces of canvas rolls of a paper machine and passing a wet paper web through the canvas rolls of the paper machine (1)

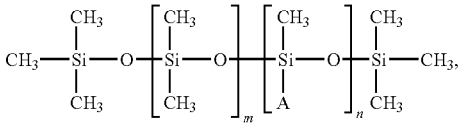

wherein m and n are each an integer.

11. A canvas roll contamination preventive method according to claim 10, wherein sidechain A is substituted with an epoxy-containing organic functional group.

* * * * *